US005995002A

United States Patent [19]

Fallin et al.

[11] Patent Number: 5,995,002

[45] Date of Patent: Nov. 30, 1999

[54] LINE SYNCHRONIZED DELAYS FOR MULTIPLE PULSED EAS SYSTEMS

[75] Inventors: David Fallin, Coral Springs; Brent F. Balch, Fort Lauderdale, both of Fla.

[73] Assignee: Sensormatic Electronics Corporation, Boca Raton, Fla.

[21] Appl. No.: 08/980,385

[22] Filed: Nov. 28, 1997

[51] Int. Cl.[6] ..... G08B 26/00

[52] U.S. Cl. ..... 340/505; 340/572; 340/310.04; 340/552; 455/127

[58] Field of Search ..... 340/505, 572, 340/310.01, 310.02, 310.04, 551, 571; 455/127, 114, 121, 125, 126

[56] References Cited

U.S. PATENT DOCUMENTS

| | | | |
|---|---|---|---|
| 4,368,434 | 1/1983 | Miller et al. | 329/50 |
| 4,527,152 | 7/1985 | Scarr et al. | 340/572 |
| 4,644,286 | 2/1987 | Torre | 329/50 |
| 4,658,241 | 4/1987 | Torre | 340/551 |
| 4,675,658 | 6/1987 | Anderson et al. | 340/551 |
| 4,963,880 | 10/1990 | Torre et al. | 343/866 |
| 5,023,600 | 6/1991 | Szklany et al. | 340/572 |
| 5,049,857 | 9/1991 | Plonsky et al. | 340/551 |
| 5,239,696 | 8/1993 | Balch et al. | 340/572 |
| 5,353,011 | 10/1994 | Wheeler et al. | 340/572 |
| 5,495,229 | 2/1996 | Balch et al. | 340/551 |
| 5,640,693 | 6/1997 | Balch et al. | 455/127 |

*Primary Examiner*—Edward Lefkowitz
*Assistant Examiner*—Daryl C. Pope
*Attorney, Agent, or Firm*—Quarles & Brady LLP

[57] ABSTRACT

A method for initializing an electronic article surveillance (EAS) system which transmits pulses into an interrogation zone and receives signals from the interrogation zone in a sequence of multiple successive transmit and receive windows during each line period of an AC mains supply energizing the EAS system, associated with a corresponding apparatus, comprises the steps of: (a.) determining whether a delay value is stored in a nonvolatile memory; (b.)if the delay value is stored in the nonvolatile memory, loading the stored delay value into a delay control register, terminating the initializing and omitting all remaining steps; (c.) if the delay value is not stored in the nonvolatile memory, loading a first delay value into the delay control register; (d.) determining whether noise in a certain receive window is less than a threshold level; (e.) if the noise is less than the threshold level, terminating the initializing and omitting all remaining steps; (f.) if the noise level is not less than the threshold level, loading a second delay value into the delay control register; (g.) determining if the EAS system is operating properly; (h.) if the EAS system is operating properly, terminating the initializing and omitting all remaining steps; (i.) if the EAS system is not operating properly, loading the first delay value into the delay control register; and, (j.) terminating the initializing.

14 Claims, 3 Drawing Sheets

LINE SYNCHRONIZED DELAYS FOR MULTIPLE PULSED EAS SYSTEMS

BACKGROUND OF THE INVENTION

1. Field of the Invention

This invention relates to the field of pulsed magnetic electronic article surveillance (EAS) systems, and in particular, to generating accurate line synchronized delays for synchronizing operation of multiple EAS systems operating in proximity to one another.

2. Description of Related Art

When multiple pulsed magnetic EAS systems operate in proximity, their transmitter timing windows must never coincide with their receiver timing windows.

In certain pulsed magnetic EAS systems available from Sensormatic Corporation, the operation of such multiple EAS systems is synchronized by sensing the positive zero crossings of the local mains power line. Each line cycle is divided up into six time windows: three for transmission and three for reception, as shown in FIG. 3. The first transmit-receive window sequential pair, designated phase A, occurs at 0° with respect to the zero crossing. The second transmit-receive window sequential pair, designated phase B, occurs at 120° with respect to the zero crossing. The third transmit-receive window sequential pair, designated phase C, occurs at 240° with respect to the zero crossing.

Ideally, two or more systems in proximity sense the same zero crossing and do not interfere with one another. Sometimes, however, the two or more EAS systems are connected to different phases of a building's three phase power supply, and it may be desired to delay one system's zero crossing signal, for example, from phase A to phase B. It can also sometimes happen through a building being mis-wired that two EAS systems can be connected with their respective zero crossings 180° apart. This results in one system's transmitter burst being centered in the other system's receiver window and vice versa. Systems cannot function in this mode. When this happens, the usual approach is to rewire one system's input power leads. The rewiring process is tedious and can be dangerous.

In present Ultra*Max pulsed magnetic EAS systems available from Sensormatic Corporation, reliance has been placed on analog circuitry to produce long zero crossing synchronizing delays. For purposes of the inventive arrangements, long delay times refers to delays of up to one whole period of the power line frequency, namely 16.6 sec for 60 Hz power and 20 msec for 50 Hz power. In designs which did incorporate digital or microprocessor generated delays, these designs utilized digital delays only for fine adjustment of the analog delays.

SUMMARY OF THE INVENTION

In accordance with the inventive arrangements, microcontroller or microprocessor control of a digital delay circuit allows accurate control of long delay times required by multiple installations of pulsed magnetic EAS systems.

Many field service calls for EAS systems are due in part to system timing problems. By improving the reliability and accuracy of inter-system timing, many of these service calls can be eliminated. In the rare cases where building wiring dictates reversing a system's power leads, the system can, either at self test or on demand, simulate a phase reversal by delaying the zero crossing synchronizing signal by half of the period of the local power line, simplifying installation and reducing related field service calls.

A digital system in accordance with an inventive arrangement, for controlling line synchronizing delays in electronic article surveillance (EAS) system, comprises: an AC mains supply zero crossing detector; a digital delay control register for receiving and storing delay values representing a line synchronizing delay; a digital delay circuit responsive to the zero crossing detector and to the delay control register, the digital delay circuit; supplying signals representative of zero crossings delayed up to at least as long as a line period of the AC mains supply, in accordance with the delay values stored in the digital delay control register; a sampling clock for the digital delay circuit; a digital delay selector responsive to the zero crossing detector, the digital delay circuit and the digital delay control register; and, a digital microcontroller responsive to the digital delay selector and to output signals from a receiver of the EAS system, the microcontroller being coupled to a bidirectional control interface of the EAS system and having a memory for storing delay values corresponding to line synchronizing delays, the microcontroller retrieving the stored delay values from the memory and suppling the retrieved delay values to the delay control register.

Advantageously, a line synchronizing delay is generated from a certain zero crossing sensed by the detector, the system being non responsive to all subsequently sensed zero crossings for at least approximately 95% of the line period of the AC mains supply following the certain zero crossing.

Advantageously, the digital delay circuit controllably generates line synchronizing delays equal to one line period of the AC mains supply and to one-half of the line period of the AC mains supply.

The delay selector selects between a signal representing a certain zero crossing and a signal representing a delayed version of the certain zero crossing, responsive to the delay control register.

A method in accordance with another inventive arrangement, for initializing an electronic article surveillance (EAS) system which transmits pulses into an interrogation zone and receives signals from the interrogation zone in a sequence of multiple successive transmit and receive windows during each line period of an AC mains supply energizing the EAS system, comprises the steps of: (a.) determining whether a delay value is stored in a nonvolatile memory; (b.)if the delay value is stored in the nonvolatile memory, loading the stored delay value into a delay control register, terminating the initializing and omitting all remaining steps; (c.) if the delay value is not stored in the nonvolatile memory, loading a first delay value into the delay control register; (d.) determining whether noise in a certain receive window is less than a threshold level; (e.) if the noise is less than the threshold level, terminating the initializing and omitting all remaining steps; (f.) if the noise level is not less than the threshold level, loading a second delay value into the delay control register; (g.) determining if the EAS system is operating properly; (h.) if the EAS system is operating properly, terminating the initializing and omitting all remaining steps; (i.) if the EAS system is not operating properly, loading the first delay value into the delay control register; and, (j.) terminating the initializing.

The method can further comprise the steps of, prior to step (a.): (α.) detecting zero crossings of the AC mains supply energizing the EAS system; and, (β.) determining whether the AC mains supply has a line frequency of 50 Hz or 60 Hz and adjusting operating parameters of the EAS system according to the determined line frequency.

The method can further comprise the steps of, subsequent to the step (α.): terminating the initializing if no zero crossings are detected within a predetermined time interval, indicating a failure condition; and, omitting all remaining steps. The method further comprise the steps of, subsequent to the step (β.): terminating the initializing if no line frequency is detected corresponding to the 50 Hz or the 60 Hz, indicating a failure condition; and, omitting all remaining steps.

Advantageously, the method further comprises the steps of: in conjunction with the steps (c.) and (i.), assigning the first delay value to correspond to no delay; and, in conjunction with the step (f.), assigning the second delay value to correspond to a delay of a half line period of the AC mains supply.

The method can further comprise the steps of, prior to the step (d.): (α.) determining whether the system has been manually commanded to load the second delay value of the step (f.) into the delay control register; (β.) omitting the step (d.), (e.) (f.); and, (γ.) undertaking the steps (g.), (h.), (i.) and (j.).

DETAILED DESCRIPTION OF THE PREFERRED EMBODIMENTS

Figure 1:
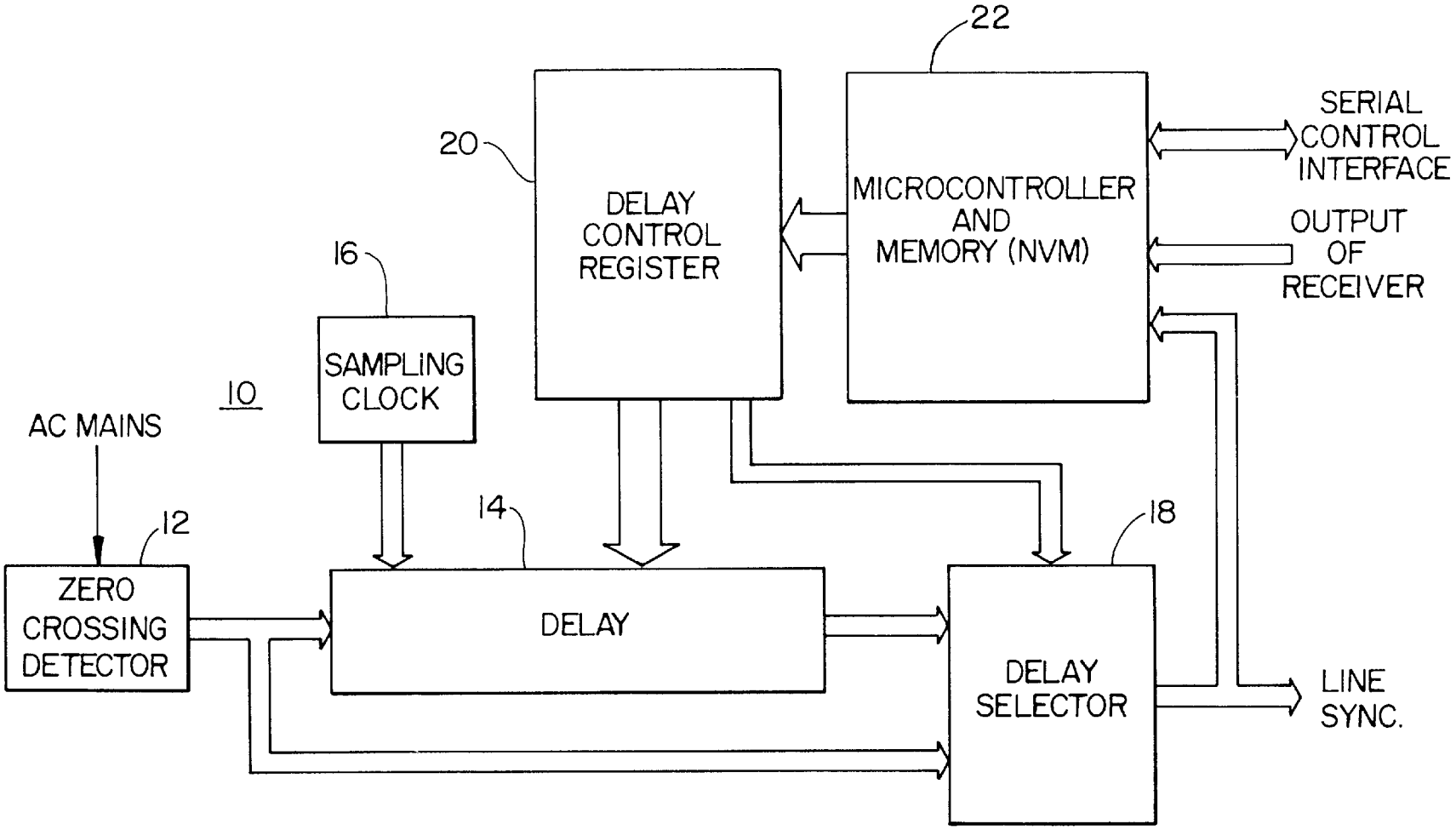
FIG. 1 is as block diagram of a line synchronizing delay circuit in accordance with the inventive arrangements.

A block diagram of a line synchronizing delay circuit 10 is shown in FIG. 1. A zero crossing detector 12 has a comparator circuit connected to the system's AC mains power line input and senses the local positive-going zero crossing. The output of the zero crossing detector provides a logic level output which is supplied to a delay circuit 1 and a delay select circuit 18. The delay circuit 14 is incremented by a sampling clock 16 and receives input control signals from a delay control register 20. The output of the delay circuit 14 is a second input to the delay select circuit 18. The delay select circuit 18 generates line synchronizing signals, or pulses, to the microcontroller or microprocessor 22, as well as to other parts of the EAS system, not shown. The microcontroller includes a memory, not separately shown. The microcontroller also receives output signals from the receiver, not shown, and is connected for bidirectional communication to a control interface of the EAS system. The microcontroller supplies commands for specific delays which are stored in the delay control register 20, and which in turn, form the basis for control information supplied to the delay circuit 14 and to the delay select circuit 18. The microprocessor, under the control of the system installer, provides the required long delay time by counting clock cycles in a large counter in memory. After the desired delay time, the microprocessor begins generating control signals to initiate transmitter and receiver timing windows.

It is desirable to prevent amplitude modulated (AM) noise on the building's power line from creating false or multiple trips of the line synchronizing circuit. Accordingly, once the first comparator edge is detected, indicating a positive zero crossing, the microprocessor disables further interrupts from the zero crossing circuit 12 for about 95% of the line period. The microcontroller re-enables the interrupt from the zero crossing detector circuit and remains ready to receive the next edge. In this way, noisy power lines are less likely to cause false triggering of the line synchronizing circuit and the system will operate more reliably.

By providing digital control of the delay times, not only are the delays more repeatable than with the older analog technique, but by delaying the transmitter by 95% or more of the expected period of the local power line, the microprocessor can simulate a phase leading condition, necessary when nearby systems appear to be operating ahead of the zero crossing. This cannot be readily done using analog delay circuits.

Current pulsed magnetic EAS systems sense their local power line frequency at power up. Once the line frequency is known, the system checks a location in non-volatile memory to determine if any line synchronizing delay is required. If so, the system begins its operating sequence using this delay, if not, it defaults to zero delay.

In accordance with the inventive arrangements, as part of the power-up self-test, the system checks for other systems nearby which may be operating with their zero crossings shifted by 180°. If the system finds this 180° difference, the system delays its own line synchronizing signal by one half period, effectively starting on the other, that is the negative-going, zero crossing.

Figure 2:
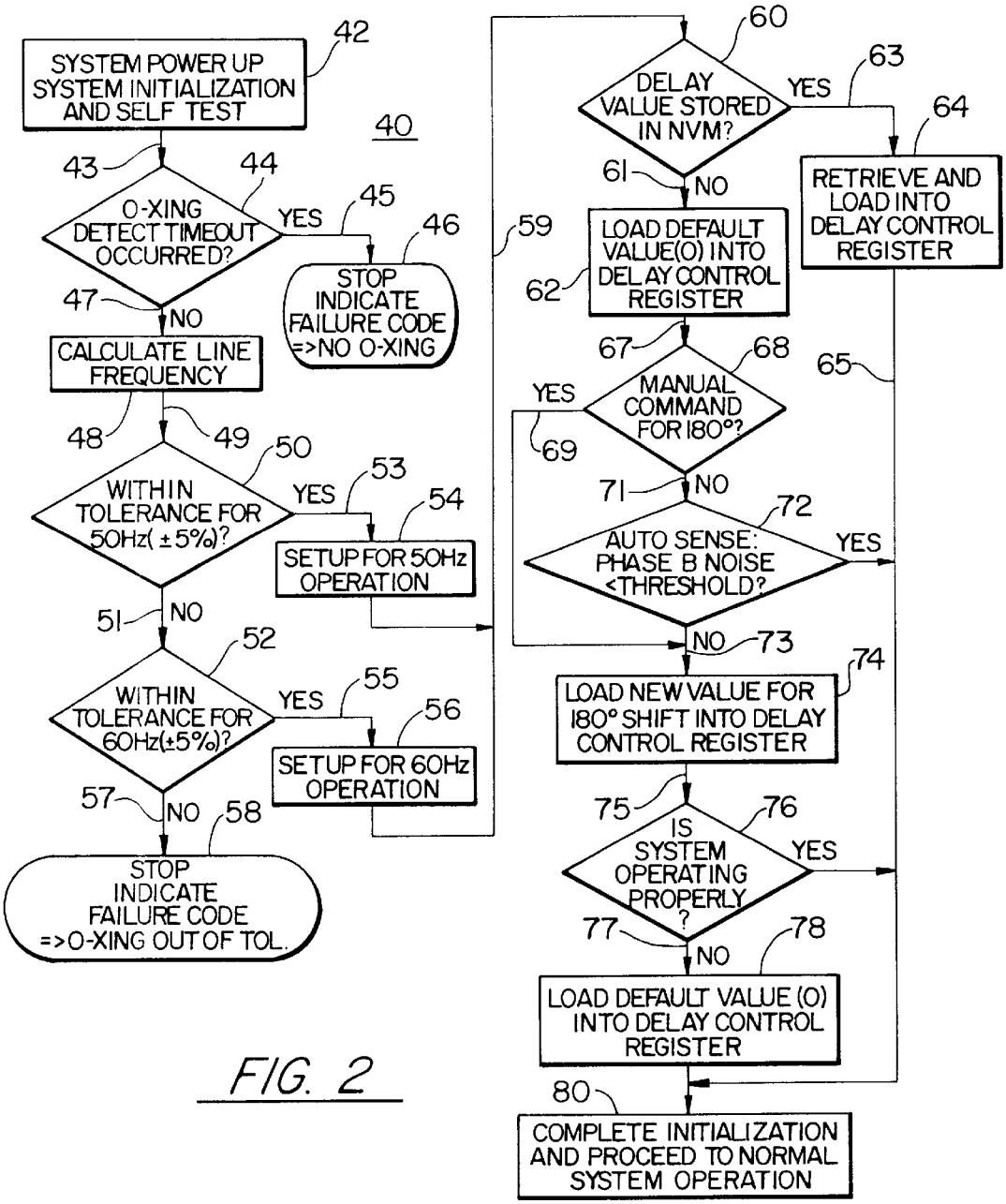
FIG. 2 is a flow chart useful for explaining the generation of line synchronizing delays in accordance with the inventive arrangements.
Figure 3:
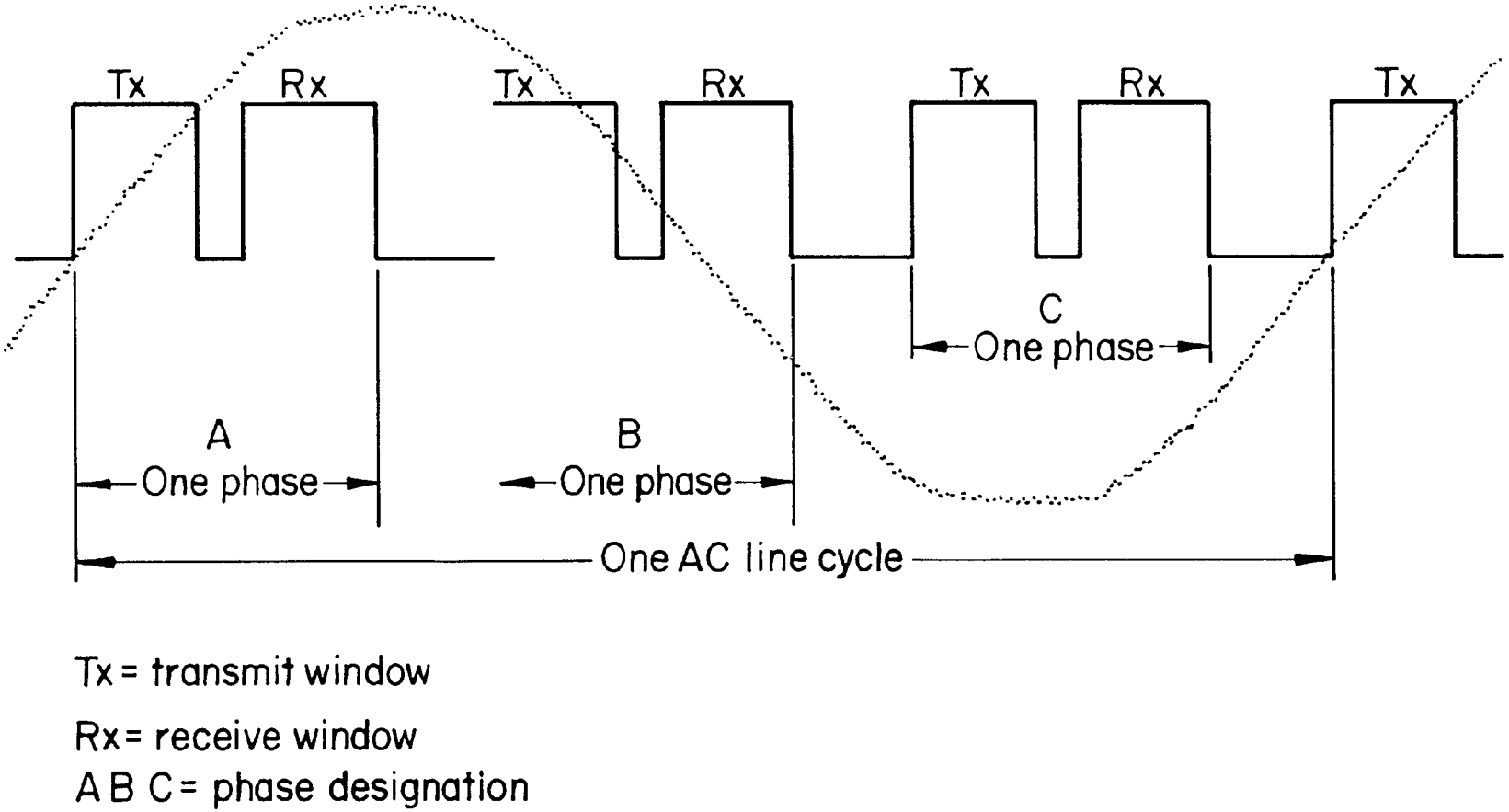
FIG. 3 is a timing diagram useful for explaining the relationship of the transmitter and receiver timing intervals relative to the local AC mains supply.

A complete initialization method is illustrated by the flow chart 40 shown in FIG. 2. Initialization begins with the system power-up and self-test in block 42. Path 42 leads to decision block 44, in which the occurrence of the zero crossing (O-xing) detect timeout is questioned. If no zero crossing is detected within a predetermined time period, path 45 leads to block 46. Block 46 stops the initialization process and generates a failure code that no zero crossing was detected.

If the timeout does not occur, that is, if a zero crossing is detected, path 49 leads to block 48, in accordance with which the line frequency is calculated. Path 49 leads to decision block 50, which checks whether the line frequency is 50 Hz. If so, the process branches on path 53 to block 54, which sets system parameters for operation at 50 Hz. If not, the process branches on path 51 to decision block 52, which checks whether the line frequency is 60 Hz. If so, the process branches on path 55 to block 56, which sets system parameters for operation at 60 Hz. If not, the process branches on path 57 to block 58, in accordance with which the initialization process is terminated. A failure code is generated indicating that the zero crossing frequency is out of tolerance, that is, the calculated frequency is neither 50 Hz nor 60 Hz.

In the event that the system has been set up for operation at 50 Hz or 60 Hz, path 59 leads to decision block 60. It is necessary to know if a delay value is stored in the nonvolatile memory (NVM) of the microcontroller. If the delay value is stored in the NVM, path 63 lead to block 64, in accordance with which the delay value is retrieved from the NVM and loaded into the delay control register 20. When the delay value has been loaded in block 63, path 65 branches to block 80, in accordance with which the initialization is completed and normal system operation is initiated. If there is no delay value stored in the NVM, path 61 branches to block 62.

Block 62 loads a default value, for example 0 corresponding to no delay or phase shift, into the delay control register. Thereafter, path 67 leads to decision block 68, which determines whether or not a system installer has manually entered a command for a 180° delay value. If so, the process branches on path 69 to block 74, which loads a delay value into the delay control register corresponding to a 180° phase shift or delay. If not, the process branches on path 71 to decision block 72, which determines whether or not noise in the phase B receive window is less than a predetermined threshold. If not, the process branches on path 73 to block 74, which loads the delay value for 180° as explained above. If so, the process branches to path 65, which leads to block 80, which completes initialization as explained above.

If a delay value has been loaded in accordance with block 74, path 75 leads to decision block 76, which determines whether or not the system is operating properly, that is no interfering transmitter signals form other systems appear in the receiver windows, with the delay value loaded in block 74. If so, the process branches to path 65, which leads to block 80, which completes initialization as explained above. If the system is not operating properly, path 77 branches to block 78 which, like block 62, loads a delay value into the delay control register corresponding to 0° phase shift or delay. Thereafter, the process concludes in block 80, completing the initialization.

Utilizing the apparatus described in connection with FIG. 1, and as a result of the process explained in connection with FIG. 2, the EAS system advantageously checks for zero crossings, checks for 50 Hz or 60 Hz operation, determines whether a full period synchronizing delay is necessary, and if necessary, digitally implements such a delay.

What is claimed is:

1. A digital system for controlling line synchronizing delays in electronic article surveillance (EAS) system, comprising:

an AC mains supply zero crossing detector;

a digital delay control register for receiving and storing delay values representing a line synchronizing delay;

a digital delay circuit responsive to said zero crossing detector and to said delay control register, said digital delay circuit supplying signals representative of zero crossings delayed up to at least as long as a line period of said AC mains supply, in accordance with said delay values stored in said digital delay control register;

a sampling clock for said digital delay circuit;

a digital delay selector responsive to said zero crossing detector, said digital delay circuit and said digital delay control register; and, a digital microcontroller responsive to said digital delay selector and to output signals from a receiver of said EAS system, said microcontroller being coupled to a bidirectional control interface of said EAS system and having a memory for storing delay values corresponding to line synchronizing delays, said microcontroller retrieving said stored delay values from said memory and suppling said retrieved delay values to said delay control register.

2. The system of claim 1, wherein a line synchronizing delay is generated from a certain zero crossing sensed by said detector, said system being non responsive to all subsequently sensed zero crossings for at least approximately 95% of said line period of said AC mains supply following said certain zero crossing.

3. The system of claim 1, wherein said digital delay circuit controllably generates line synchronizing delays equal to one line period of said AC mains supply and to one-half of said line period of said AC mains supply.

4. The system of claim 1, wherein said delay selector selects between a signal representing a certain zero crossing and a signal representing a delayed version of said certain zero crossing, responsive to said delay control register.

5. A method for initializing an electronic article surveillance (EAS) system which transmits pulses into an interrogation zone and receives signals from said interrogation zone in a sequence of multiple successive transmit and receive windows during each line period of an AC mains supply energizing said EAS system, comprising the steps of:

(a.) determining whether a delay value is stored in a nonvolatile memory;

(b.)if said delay value is stored in said nonvolatile memory, loading said stored delay value into a delay control register, terminating said initializing and omitting all remaining steps;

(c.) if said delay value is not stored in said nonvolatile memory, loading a first delay value into said delay control register;

(d.) determining whether noise in a certain receive window is less than a threshold level;

(e.) if said noise is less than said threshold level, terminating said initializing and omitting all remaining steps;

(f.) if said noise level is not less than said threshold level, loading a second delay value into said delay control register;

(g.) determining if said EAS system is operating properly;

(h.) if said EAS system is operating properly, terminating said initializing and omitting all remaining steps;

(i.) if said EAS system is not operating properly, loading said first delay value into said delay control register; and, (j.) terminating said initializing.

6. The method of claim 5, further comprising the steps of, prior to step (a.):

(α.) detecting zero crossings of said AC mains supply energizing said EAS system; and, (β.) determining whether said AC mains supply has a line frequency of 50 Hz or 60 Hz and adjusting operating parameters of said EAS system according to said determined line frequency.

7. The method of claim 6, comprising the steps of, subsequent to said step (α.):

terminating said initializing if no said zero crossings are detected within a predetermined time interval; and, omitting all remaining steps.

8. The method of claim 6, comprising the steps of, subsequent to said step (α.):

terminating said initializing if no line frequency is detected corresponding to said 50 Hz or said 60 Hz; and, omitting all remaining steps.

9. The method of claim 5, comprising the steps of:

in conjunction with said steps (c.) and (i.), assigning said first delay value to correspond to no delay; and, in conjunction with said step (f.), assigning said second delay value to correspond to a delay of a half line period of said AC mains supply.

10. The method of claim 5, further comprising the steps of, prior to said step (d.):

(α.) determining whether said system has been manually commanded to load said second delay value of said step (f.) into said delay control register;

(β.) omitting said step (d.), (e.) (f.); and, (γ.) undertaking said steps (g.), (h.), (i.) and (j.).

11. An electronic article surveillance system (EAS, comprising:

a plurality of pulsed magnetic EAS systems operating in close enough proximity to one another that signals transmitted into respective interrogation zones can interfere with one another;

each of said plurality of pulsed magnetic EAS systems having a digital system for controlling line synchronizing delays, said digital system for controlling said line synchronizing delays comprising:

an AC mains supply zero crossing detector;

a digital delay control register for receiving and storing delay values representing a line synchronizing delay;

a digital delay circuit responsive to said zero crossing detector and to said delay control register, said digital delay circuit supplying signals representative of zero crossings delayed up to at least as long as a line period of said AC mains supply, in accordance with said delay values stored in said digital delay control register;

a sampling clock for said digital delay circuit;

a digital delay selector responsive to said zero crossing detector, said digital delay circuit and said digital delay control register; and, a digital microcontroller responsive to said digital delay selector and to output signals from a receiver of said EAS system, said microcontroller being coupled to a bidirectional control interface of said EAS system and having a memory for storing delay values corresponding to line synchronizing delays, said microcontroller retrieving said stored delay values from said memory and suppling said retrieved delay values to said delay control register.

12. The system of claim 11, wherein a line synchronizing delay in each of said plurality of pulsed magnetic EAS systems is generated from a certain zero crossing sensed by said detector, said system being non responsive to all subsequently sensed zero crossings for at least approximately 95% of said line period of said AC mains supply following said certain zero crossing.

13. The system of claim 12, wherein said digital delay circuit in each of said plurality of pulsed magnetic EAS systems controllably generates line synchronizing delays equal to one line period of said AC mains supply and to one-half of said line period of said AC mains supply.

14. The system of claim 12, wherein said delay selector in each of said plurality of pulsed magnetic EAS systems selects between a signal representing a certain zero crossing and a signal representing a delayed version of said certain zero crossing, responsive to said delay control register.

* * * * *